United States Patent [19]

Robinet

[11] 4,389,880

[45] Jun. 28, 1983

[54] RAPIDLY ERODIBLE SONDE

[75] Inventor: Alain Robinet, Muret, France

[73] Assignee: Societe Nationale Elf Aquitaine (Production), Courbevoie, France

[21] Appl. No.: 256,236

[22] Filed: Apr. 21, 1981

[30] Foreign Application Priority Data

Apr. 21, 1980 [FR] France ..... 80 08882

[51] Int. Cl.[3] ..... G01L 19/12; G01N 15/07

[52] U.S. Cl. ..... 73/86; 73/28; 73/432 PS; 116/70; 116/112

[58] Field of Search ..... 73/86, 861.73; 116/70, 116/112

[56] References Cited

U.S. PATENT DOCUMENTS

| | | | |
|---|---|---|---|
| 1,534,881 | 4/1925 | Stokoe | 116/112 |
| 1,683,489 | 9/1928 | Rice | 73/86 |
| 3,557,616 | 1/1971 | Landon, Jr. et al. | 73/861.73 |
| 3,816,773 | 6/1974 | Baldwin | 73/861.73 X |
| 4,240,287 | 12/1980 | Mast et al. | 73/61 R |

*Primary Examiner*—Daniel M. Yasich

*Attorney, Agent, or Firm*—Brisebois & Kruger

[57] ABSTRACT

An erodible sonde for detecting sand in the gas conveyed through a pipe. Such a sonde is constituted by a thin aluminium tube, one end of which communicates with a device for measuring the pressure outside the pipe and the other end of which is closed, the inner wall of this tube being in contact with a discontinuous prop or support means such as a steel spring with contiguous coils. Such a device allows early detection of the intrusion of sand in the gas.

3 Claims, 3 Drawing Figures

RAPIDLY ERODIBLE SONDE

The present invention relates to a device for detecting the intrusion of sand in gas conveyed through a pipe or conduct under pressure.

Different devices are known, which comprise a tubular sonde made of a metal adapted to be worn by the erosion caused by the sand, one end of which sonde being closed and the other end, outside the pipe, establishing a communication between the inner zone of this sonde and a device for measuring a variation in pressure. The sonde itself is generally made of steel and its wall is sufficiently thick to prevent crushing under the action of the pressure prevailing in the pipe.

These sondes, due to the thickness of the metal used, act as alarm only after a considerable quantity of sand has passed through the pipe and once the alarm has been given, it is difficult to know whether serious damage has occured to the installation. Sondes of this type could not give early warning of the intrusion of sand in the gas.

A device according to the invention overcomes this difficulty since it comprises two separate mechanical pieces, each of which is given a specific function, namely, one adapted to indicate the intrusion of a small amount of sand in the gas by its rapid piercing, the other adapted to withstand crushing under the action of the pressure prevailing in the pipe.

A device according to the invention for detecting the intrusion of sand in the gas carried along a pipe under pressure, comprises a tubular sonde made of a rapidly erodible metal, separating an inner zone of the sonde from the interior of the pipe, one end of the sonde located in the pipe being closed, and the other end, outside the pipe, establishing a communication between the inner zone of the sonde and an apparatus for detecting a pressure variation. Such a device is characterised in that this sonde comprises an envelope constituted by a thin metal foil, the inner wall of which is in contact with the surface of a prop or support means comprising a plurality of discontinuities connecting the inner wall of the envelope with the inner zone of the sonde.

In various embodiments, the prop or support means is constituted by a tube having a thickness sufficient to withstand crushing, said tube being provided with a plurality of perforations or holes.

According to an embodiment of the invention, the prop or support means is constituted by a helical spring of which the contiguous coils are made of a steel wire whose section is sufficient to withstand crushing.

According to another embodiment, the prop or support means is constituted by a compact mass of sand, filling the envelope and limited by a porous, permeable stopper located within the envelope at the extremity of the tubular sonde disposed outside the pipe.

The invention will be more readily understood on reading the following description with reference to the accompanying drawings, in which.

Figure 1:
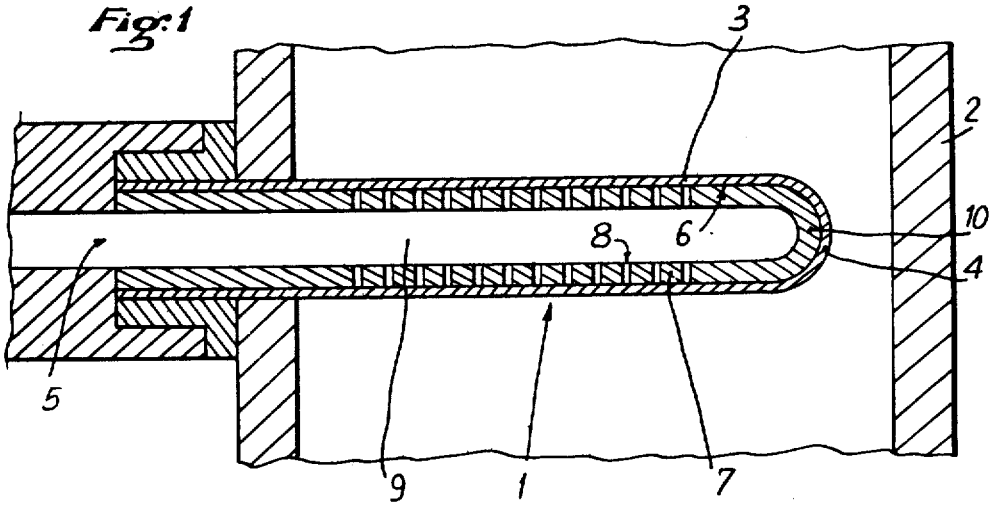
FIG. 1 shows a sonde according to the invention provided with a tubular prop or support means.

Referring now to the drawings, FIG. 1 shows, in axial section, a sonde 1 disposed in a pipe 2.

The sonde 1 comprises a tube 3 made of a thin aluminium or aluminium-alloy foil, this tube being closed at one end 4 by an end portion having the same thickness as the rest of the tube and being connected by the other end 5, outside the pipe 2, to a device known per se (not shown) for detecting a pressure variation.

The inner wall 6 of the tube 3 is in contact with a support means 7 constituted by a metal tube of thickness sufficient to withstand crushing due to the action of the pressure prevailing in the pipe 2. This tube comprises a plurality of discontinuities such as perforations 8 connecting the inner wall 6 of the tube 3 with the inner axial zone 9 of this tube. The diameters of these perforations do not exceed a few tenths of millimeters.

The end of the tubular support means oriented towards the closed end 4 of the tube 3 may be closed by an end 10 having the same thickness as the rest of the support means, and ensures support for the end 4 of the tube 3. The end of the tubular support means oriented towards the end 5 of the tube 3 is open.

Figure 2:
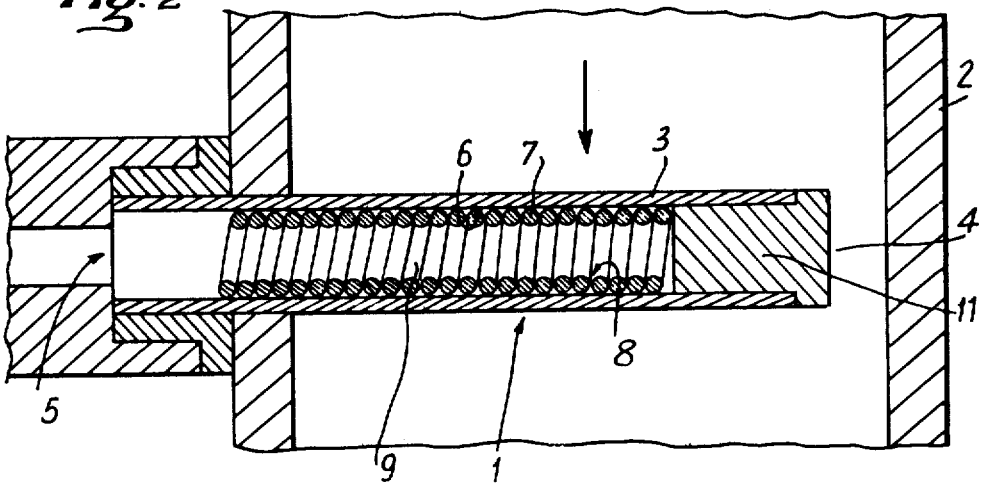
FIG. 2 shows a sonde provided with a prop or support means constituted by a helical spring.

FIG. 2 shows a sonde 1 disposed in a pipeline 2. This sonde 1 comprises a tube 3 made of a thin aluminium or aluminium-alloy foil. The end 4 of this tube 3 located inside the pipeline 2 is closed by an aluminium stopper 11 glued to the inner wall 6 of the tube 3 by a hardening glue or welded by an appropriate means such as by electron bombardment welding.

The inner wall 6 of the tube 3 is in contact with a prop or support means 7 constituted by a coil spring with contiguous coils. This spring is made of a steel wire of section sufficient to withstand crushing under the action of the pressure prevailing in the pipeline. The zone of contact between the successive coils constitutes the means of communication 8 between the inner wall 6 of the tube 3 and the inner axial zone 9.

The nature of the aluminium-alloy constituting the tube 3 is determined as a function of the composition of the fluid conveyed through the pipeline 2, and particularly of the content of aggressive products at the relevant temperature and pressure.

Figure 3:
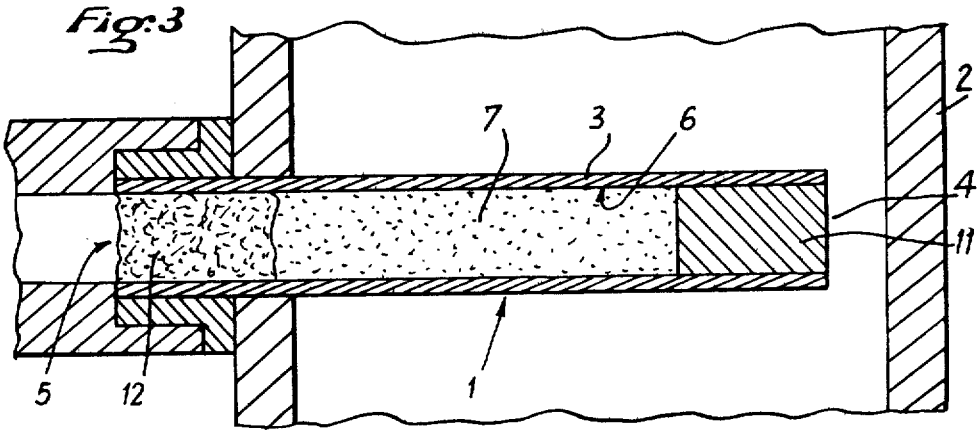
FIG. 3 shows a sonde provided with a prop or support means constituted by a compact mass of fine sand.

FIG. 3 shows a sonde 1 disposed in a pipeline 2 and comprising a tube 3, made of thin aluminium or aluminium-alloy foil such as the one described with reference to FIG. 2.

The inner wall 6 of the tube 3 is in contact with a prop or support means 7 constituted by a mass of fine sand. The end 4 of the tube 3, located inside the pipeline 2, is closed by an aluminium stopper 11, fixed on the inner wall 6 of the tube 3 by means of a hardening glue or by any other hermetic means.

The end 5 of the tube 3 located outside the pipeline 2 is provided with a stopper 12 made of a porous, permeable material such as sintered metal and hermetically fixed on the inner wall 6. This stopper 12 prevents the sand from being displaced and thus maintains its state of compactness; it allows the displacement of gas and particularly the transmission of the increase in pressure consecutive to the piercing of the tube 3.

The different types of sondes produced according to the invention have withstood tests at pressures higher than 500 bars, this pressure rarely being encountered in gas- and oil-pipelines.

With such sondes, used as detectors of sand in pipes conveying gas under pressure, the intrusion of sand can be indicated before any damage has been done to the installations. This is particularly important for pipelines laid out on the sea-bed through which the gas from offshore fields is conveyed.

What is claimed is:

1. A device for rapidly detecting the intrusion of sand in fluid conveyed in a pipeline under pressure, said device comprising, a tubular sonde comprised of a closed outer end and an inner end in fluid communication with the interior of the outer end, said outer end comprising an envelope of thin metal foil, means for mounting said sonde with said inner end outside said pipeline and with said envelope within the pipeline in the path of fluids flowing through the pipeline and exposed to the pressure in the pipeline, duct means for connecting the interior of the sonde to detecting means for detecting a pressure variation in the interior of the sonde, a support within said outer end in contact with and supporting said envelope to prevent collapse of the thin metal of the envelope as a result of pressure in the pipeline, said support having a plurality of discontinuities therein between the envelope and the interior of the sonde, said envelope of thin metal foil normally isolating the interior of the sonde from the pressure in the pipeline, but being rapidly erodable by sand entrained in the fluids flowing through the pipeline, so that the envelope is rapidly erodable upon intrusion of sand in fluid flowing through the pipeline, and the resulting pressure increase from the pipeline to the interior of the sonde, through the discontinuities of the support, is sensed by the detecting means to thereby rapidly detect the intrusion of sand.

2. The device of claim 1, wherein said support means comprises a tube of a wall thickness sufficient to withstand crushing by the pressure in the pipeline, and having a plurality of perforations, extending through its wall.

3. The device of claim 1, wherein said support means comprises a coil spring of which the contiguous coils are made of a metal wire of a section sufficient to withstand crushing by the pressure in the pipeline.

* * * * *